US006225274B1

(12) United States Patent
Nitsch et al.

(10) Patent No.: US 6,225,274 B1
(45) **Date of Patent: *May 1, 2001**

(54) ACETONITRILE DERIVATIVES AS BLEACHING ACTIVATORS IN DETERGENTS

(75) Inventors: Christian Nitsch; Rainer Jeschke, both of Duesseldorf (DE)

(73) Assignee: Henkel Kommandigesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/308,867

(22) PCT Filed: Nov. 21, 1997

(86) PCT No.: PCT/EP97/06527

§ 371 Date: May 26, 1999

§ 102(e) Date: May 26, 1999

(87) PCT Pub. No.: WO98/23719

PCT Pub. Date: Jun. 4, 1998

(30) Foreign Application Priority Data

Nov. 29, 1996 (DE) ..... 196 49 375

(51) Int. Cl.[7] ..... C11D 3/395; C11D 1/62

(52) U.S. Cl. ..... 510/314; 510/220; 510/276; 510/286; 510/302; 510/312; 510/367; 510/372; 510/376; 510/378

(58) Field of Search ..... 510/220, 276, 510/286, 302, 312, 314, 367, 372, 376, 378

(56) References Cited

U.S. PATENT DOCUMENTS

| | | | | |
|---|---|---|---|---|
| 5,599,781 | * | 2/1997 | Haeggberg et al. | 510/220 |
| 5,739,327 | * | 4/1998 | Arbogast et al. | 544/163 |
| 5,792,218 | * | 8/1998 | Alvarez et al. | 8/111 |
| 5,814,242 | * | 9/1998 | Alvarez et al. | 252/186.39 |
| 5,877,315 | * | 3/1999 | Deline et al. | 544/86 |
| 5,888,419 | * | 3/1999 | Casella et al. | 252/186.39 |

FOREIGN PATENT DOCUMENTS

| | | | |
|---|---|---|---|
| 43 15 397 | | 11/1994 | (DE) . |
| 43 25 922 | | 2/1995 | (DE) . |
| 44 16 438 | | 11/1995 | (DE) . |
| 44 43 177 | | 6/1996 | (DE) . |
| 195 18 693 | | 11/1996 | (DE) . |
| 195 29 905 | | 2/1997 | (DE) . |
| 195 36 082 | | 4/1997 | (DE) . |
| 196 05 688 | | 8/1997 | (DE) . |
| 196 13 103 | | 10/1997 | (DE) . |
| 196 20 411 | | 10/1997 | (DE) . |
| 196 16 693 | | 11/1997 | (DE) . |
| 196 16 767 | | 11/1997 | (DE) . |
| 196 16 769 | | 11/1997 | (DE) . |
| 196 16 770 | | 11/1997 | (DE) . |
| 196 20 267 | | 11/1997 | (DE) . |
| 0 272 030 | | 6/1988 | (EP) . |
| 0 303 520 | | 2/1989 | (EP) . |
| 303520 | * | 2/1989 | (EP) . |
| 0 392 592 | | 10/1990 | (EP) . |
| 0 443 651 | | 8/1991 | (EP) . |
| 0 446 982 | | 9/1991 | (EP) . |
| 0 453 003 | | 10/1991 | (EP) . |
| 0 458 396 | | 11/1991 | (EP) . |
| 0 458 397 | | 11/1991 | (EP) . |
| 0 458 398 | | 11/1991 | (EP) . |
| 458396 | * | 11/1991 | (EP) . |
| 0 464 880 | | 1/1992 | (EP) . |
| 464880 | * | 8/1992 | (EP) . |
| 0 525 239 | | 2/1993 | (EP) . |
| 0 544 490 | | 6/1993 | (EP) . |
| 0 544 519 | | 6/1993 | (EP) . |
| 0 549 271 | | 6/1993 | (EP) . |
| 0 549 272 | | 6/1993 | (EP) . |
| 0 693 550 | | 1/1996 | (EP) . |
| 01 198 700A | | 8/1989 | (JP) . |
| WO92/11347 | | 7/1992 | (WO) . |
| WO94/02597 | | 2/1994 | (WO) . |
| WO94/02618 | | 2/1994 | (WO) . |
| WO94/05762 | | 3/1994 | (WO) . |
| WO94/07981 | | 4/1994 | (WO) . |
| WO94/18314 | | 8/1994 | (WO) . |
| WO94/19445 | | 9/1994 | (WO) . |
| WO94/23005 | | 10/1994 | (WO) . |
| WO94/23053 | | 10/1994 | (WO) . |
| WO94/28102 | | 12/1994 | (WO) . |
| WO94/28103 | | 12/1994 | (WO) . |
| Wo94/27970 | | 12/1994 | (WO) . |
| Wo95/00626 | | 1/1995 | (WO) . |
| WO95/07350 | | 3/1995 | (WO) . |
| WO95/14075 | | 5/1995 | (WO) . |
| WO95/14759 | | 6/1995 | (WO) . |
| WO95/17498 | | 6/1995 | (WO) . |
| WO95/27775 | | 10/1995 | (WO) . |
| WO96/23861 | | 8/1996 | (WO) . |
| WO96/40661 | | 12/1996 | (WO) . |

OTHER PUBLICATIONS

Chemical Abstracts, vol. 112, No. 10, (1990) XP000152928 Mar. 5, 1990.
Progr. Phys. Org. Chem., vol. 11 pp. 2–87 No date available.
J.Am.Chem.Soc., vol. 102, (1980) pp. 5892–5902.

* cited by examiner

*Primary Examiner*—Yogendra Gupta
*Assistant Examiner*—Charles Boyer
(74) *Attorney, Agent, or Firm*—Wayne C. Jaeschke; Glenn E. J. Murphy

(57) ABSTRACT

A method for washing dishes containing colored soil is presented involving contacting the dish surface with a dishwashing detergent containing a peroxygen compound and an activator compound of the formula $R^1R^2R^3N^+CH_2CN\ X^-$ where $R^1$, $R^2$ and $R^3$ independently of one another represent an alkyl, alkenyl or aryl group containing 1 to 18 carbon atoms, and wherein $R^2$ and $R^3$ may be part of a heterocycle including the N atom, and X is an anion, to form an aqueous dishwashing detergent. The method is useful for washing colored stains from crockery and cutlery, and is effective at temperatures below 80° C.

16 Claims, No Drawings

ACETONITRILE DERIVATIVES AS BLEACHING ACTIVATORS IN DETERGENTS

This application is filed under 35 U.S.C. 371 and based on PCT/EP97/06527, filed Nov. 21, 1997.

BACKGROUND OF THE INVENTION

1. Field of the Invention

This invention relates to the use of certain acetonitrile derivatives as activators for peroxygen compounds, more particularly inorganic peroxygen compounds, for bleaching colored soil on dishes and to dishwashing detergents containing such activators.

2. Discussion of Related Art

Inorganic peroxygen compounds, more particularly hydrogen peroxide, and solid peroxygen compounds which dissolve in water with release of hydrogen peroxide, such as sodium perborate and sodium carbonate perhydrate, have long been used as oxidizing agents for disinfecting and bleaching purposes. The oxidizing effect of these substances in dilute solutions depends to a large extent on the temperature. For example, with $H_2O_2$ or perborate in alkaline bleaching liquors, soiled textiles are only bleached sufficiently quickly at temperatures above about 80° C. At lower temperatures, the oxidizing effect of the inorganic peroxygen compounds can be improved by the addition of so-called bleach activators, for which numerous proposals, above all from the classes of N- or O-acyl compounds, for example polyacylated alkylenediamines, more especially tetraacetyl ethylenediamine, acylated glycolurils, more especially tetraacetyl glycoluril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxy benzenesulfonate, sodium isononanoyloxy benzenesulfonate, and acylated sugar derivatives, such as pentaacetyl glucose, have become known in the literature. By adding these substances, the bleaching effect of aqueous peroxide liquors can be increased to such an extent that substantially the same effects are obtained at temperatures of only around 60° C. as are obtained with the peroxide liquor alone at 95° C.

In the search to find energy-saving washing and bleaching processes, application temperatures well below 60° C., more particularly below 45° C. down to the temperature of cold water, have acquired increasing significance in recent years.

At these low temperatures, there is generally a discernible reduction in the effect of the hitherto known activator compounds. Accordingly, there has been no shortage of attempts to develop more effective activators for this temperature range, but so far to no real avail.

Another problem which particularly affects machine dishwashing detergents is the need to incorporate corrosion inhibitors for table silver in such detergents, particularly where the detergents contain the oxygen-based bleaching or oxidizing agents which have recently become more widespread. During the dishwashing process, silver is capable of reacting with sulfur-containing substances dissolved or dispersed in the wash liquor, because food residues, including inter alia mustard, peas, egg and other sulfur-containing compounds, such as mercaptoamino acids, are introduced into the wash liquor in the cleaning of dishes in domestic dishwashing machines. The far higher temperatures prevailing during machine dishwashing and the longer contact times with the sulfur-containing food remains also promote the tarnishing of silver by comparison with manual dishwashing. In addition, the silver surface is completely degreased by the intensive cleaning process in the dishwashing machine and, as a result, becomes more sensitive to chemical influences.

The problem of tarnishing becomes acute in particular when active oxygen compounds, for example sodium perborate or sodium percarbonate, are used alternatively to the active chlorine compounds which oxidatively "deactivate" the sulfur-containing substances in order to eliminate bleachable soils, such as for example tea stains/tea films, coffee residues, dyes from vegetables, lipstick residues and the like.

Active oxygen bleaching agents of the type in question are generally used together with bleach activators, above all in modern low-alkali machine dishwashing detergents of the new generation. These detergents generally consist of the following functional components: builder component (complexing agent/dispersant), alkali carrier, bleaching system (combination of bleaching agent and bleach activator), enzyme and surfactant. Under the dishwashing conditions prevailing where detergents such as these are used, not only sulfidic coatings, but also oxidic coatings are generally formed on the silver surfaces—where silver is present—through the oxidizing effect of the peroxides formed as intermediates or the active oxygen.

The problem addressed by the present invention was to improve the oxidizing and bleaching effect of peroxygen compounds, more especially inorganic peroxygen compounds, at low temperatures below 80° C. and, more particularly, at temperatures in the range from about 15° C. to 55° C.

It has now been found that certain acetonitrile derivatives which carry a quaternary nitrogen substituent have a distinct bleach-boosting effect on colored stains on crockery, such as saucers and plates, or cutlery when used together with peroxidic bleaching agents.

DESCRIPTION OF THE INVENTION

The present invention relates to the use of compounds corresponding to general formula I:

$$R^1R^2R^3N^+CH_2CN\ X^- \qquad (I)$$

in which $R^1$, $R^2$ and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion, as activators for peroxygen compounds, more especially inorganic peroxygen compounds, in aqueous cleaning solutions for dishes.

Compounds corresponding to formula I may be prepared by known methods, as published for example by Abraham in Progr. Phys. Org. Chem. 11 (1974), pages 1 et seq. or by Arnett in J. Am. Chem. Soc. 102 (1980), pages 5892 et seq., or by similar methods. Some compounds corresponding to general formula I are described in hitherto unpublished International patent application PCT/US 96/08497.

It is particularly preferred to use compounds corresponding to formula I in which $R^2$ and $R^3$ form a morpholinium ring together with the quaternary nitrogen atom. In these compounds, $R^1$ is preferably an alkyl group containing 1 to 3 carbon atoms, more especially a methyl group.

The anions $X^-$ include, in particular, the halides, such as chloride, fluoride, iodide and bromide, nitrate, hydroxide, hexafluorophosphate, metho- and ethosulfate, chlorate, perchlorate and the anions of carboxylic acids, such as formate, acetate, benzoate or citrate. Compounds corresponding to formula I in which $X^-$ is methosulfate are preferably used.

An acetonitrile derivative corresponding to formula I is preferably used in dishwashing solutions for bleaching colored stains. In the context of the present invention, the term bleaching is understood to encompass both the bleaching of soil present on the surface of the dishes, more especially tea, and the bleaching of soil present in the dishwashing liquor after detachment from the surface.

The present invention also relates to dishwashing detergents, preferably machine dishwashing detergents, containing a compound corresponding to formula I of the type described above and to a dishwashing process using such a compound.

The use according to the invention as a bleach activator essentially comprises creating conditions—in the presence of a surface soiled with colored soils—under which a peroxidic oxidizing agent and the bleach-activating acetonitrile derivative are capable of reacting with one another with a view to obtaining reaction products having a stronger oxidizing effect. Conditions of the type in question prevail in particular when the two reactants meet one another in aqueous solution. This can be achieved by separately adding the peroxygen compound and the acetonitrile derivative to an optionally detergent-containing solution. However, the process according to the invention is carried out with particular advantage using a dishwashing detergent according to the invention which contains the bleach-activating acetonitrile derivative and optionally a peroxygen-containing oxidizing agent preferably selected from the group consisting of organic peracids, hydrogen peroxide, perborate and percarbonate and mixtures thereof. The peroxygen compound may even be separately added to the solution either as such or preferably in the form of an aqueous solution or suspension in cases where a peroxide-free detergent is used.

The conditions may be varied within wide limits, depending on the application envisaged. Thus, besides pure aqueous solutions, mixtures of water and suitable organic solvents may also be used as the reaction medium. The quantities of peroxygen compounds used are generally selected so that the solutions contain between 10 ppm and 10% of active oxygen and preferably between 50 ppm and 5,000 ppm of active oxygen. The quantity of bleach-activating acetonitrile derivative used also depends on the application envisaged. Depending on the required degree of activation, between 0.00001 mole and 0.25 mole and preferably between 0.001 mole and 0.02 mole of activator is used per mole of peroxygen compound, although larger or smaller quantities may also be used in special cases.

The present invention also relates to a dishwashing detergent containing 1% by weight to 10% by weight and, more particularly, 3% by weight to 6% by weight of an acetonitrile derivative corresponding to formula I in addition to typical ingredients compatible with the compound. The bleach activator may be adsorbed onto supports and/or encapsulated in shell-forming substances in known manner.

In addition to the bleach activator used in accordance with the invention, the detergents according to the invention, which may be present as powder-form or tablet-form solids, homogeneous solutions or suspensions, may in principle contain any of the known ingredients typically encountered in such detergents. More particularly, the detergents according to the invention may contain builders, surfactants, peroxygen compounds, water-miscible organic solvents, enzymes, sequestering agents, electrolytes, pH regulators and other auxiliaries, such as silver corrosion inhibitors, foam regulators, additional bleach boosters and dyes and fragrances.

In addition, a detergent according to the invention may contain abrasive ingredients, more especially from the group consisting of silica flours, wood flours, polymer powders, chalks and glass microbeads and mixtures thereof. Abrasives are present in the detergents according to the invention in quantities of preferably not more than 20% by weight and, more particularly, in quantities of 5% by weight to 15% by weight.

The present invention also relates to a machine dishwashing detergent containing 15% by weight to 70% by weight and, more especially, 20% by weight to 60% by weight of a water-soluble builder component, 5% by weight to 25% by weight and, more especially, 8% by weight to 17% by weight of an oxygen-based bleaching agent, based on the detergent as a whole, characterized in that it contains a bleach-activating acetonitrile derivative corresponding to formula I, more especially in quantities of 3% by weight to 6% by weight. A detergent of the type in question is preferably a low-alkali detergent, i.e. a 1% by weight solution of the detergent has a pH value of 8 to 11.5 and, more particularly, in the range from 9 to 11.

In principle, the water-soluble builder component, more especially in low-alkali machine dishwashing detergents of the type in question, may be selected from any of the builders typically used in machine dishwashing detergents, for example alkali metal phosphates which may be present in the form of their alkaline, neutral or acidic sodium or potassium salts. Examples of such alkali metal phosphates are trisodium phosphate, tetrasodium diphosphate, disodium dihydrogen diphosphate, pentasodium triphosphate, so-called sodium hexametaphosphate, oligomeric trisodium phosphate with degrees of oligomerization of 5 to 1,000 and, more particularly, 5 to 50, and mixtures of sodium and potassium salts. They may be present in quantities of up to about 55% by weight, based on the detergent as a whole. The low-alkali detergents according to the invention are preferably free from such phosphates. Other possible water-soluble builder components are, for example, organic polymers of native or synthetic origin, above all polycarboxylates which act as co-builders, particularly in hard water areas. Examples of builders such as these are, for example, polyacrylic acids and copolymers of maleic anhydride and acrylic acid and the sodium salts of these polymer acids. Commercially available products are, for example, Sokalan® CP 5, CP 10 and PA 30 (BASF). The polymers of native origin suitable as co-builders include, for example, the oxidized starches known, for example, from International patent application WO 94/05762 and polyamino acids, such as polyglutamic acid or polyaspartic acid. Other possible builder components are naturally occurring hydroxycarboxylic acids such as, for example, mono- and dihydroxysuccinic acid, α-hydroxypropionic acid and gluconic acid. Preferred builder components are the salts of citric acid, more especially sodium citrate. The sodium citrate used may be anhydrous sodium citrate and is preferably trisodium citrate dihydrate. Trisodium citrate dihydrate may be used as a fine or coarse crystalline powder. The acids corresponding to the co-builder salts mentioned may also be at least partly present, depending on the pH value ultimately established in the detergents according to the invention.

Suitable oxygen-based bleaching agents are, above all, alkali metal perborate monohydrate and tetrahydrate and/or alkali metal percarbonate and alkali metal persulfates, persilicates and percitrates, sodium being the preferred alkali metal. The use of sodium percarbonate has advantages, especially in dishwashing detergents, because it has a particularly favorable effect on the corrosion behavior of glasses. Accordingly, the oxygen-based bleaching agent is preferably an alkali metal percarbonate, more especially sodium percarbonate. Known peroxycarboxylic acids, for example dodecane diperacid, or phthalimidopercarboxylic acids which may optionally be substituted at the aromatic radical may be present in addition to or, more particularly, as an alternative to the oxygen-based bleaching agent. Moreover, the addition of small quantities of known bleach stabilizers, for example phosphonates, borates and metaborates and metasilicates and also magnesium salts, such as magnesium sulfate, can be useful.

In addition to the above-mentioned bleach-activating acetonitrile derivatives corresponding to formula I, known conventional bleach activators, i.e. compounds which form aliphatic peroxocarboxylic acids preferably containing 1 to 10 carbon atoms and, more particularly, 2 to 4 carbon atoms and/or optionally substituted perbenzoic acid under perhydrolysis conditions, may be used. Suitable conventional bleach activators are substances which carry O- and/or N-acyl groups with the number of carbon atoms mentioned and/or optionally substituted benzoyl groups. Preferred conventional bleach activators are polyacylated alkylenediamines, more especially tetraacetyl ethylenediamine (TAED), acylated triazine derivatives, more especially 1,5-diaacetyl-2,4-dioxohexahydro-1,3,5-triazine (DADHT), acylated glycolurils, more especially tetraacetyl glycoluril (TAGU), N-acyl imides, more especially N-nonanoyl succinimide (NOSI), carboxylic anhydrides, more especially phthalic anhydride, acylated polyhydric alcohols, more especially triacetin, ethylene glycol diacetate, 2,5-diacetoxy-2,5-dihydrofuran and the enol esters known from German patent applications DE 196 16 693 and DE 196 16 767 and also acetylated sorbitol and mannitol and the mixtures thereof (SORMAN) described in European patent application EP 0 525 239, acylated sugar derivatives, more especially pentaacetyl glucose (PAG), pentaacetyl fructose, tetraacetyl xylose and octaacetyl lactose and acetylated, optionally N-alkylated, glucamine and glucolactone, and/or the N-acylated lactams, for example N-benzoyl caprolactam, which are known from International patent applications WO 94/27970, WO 94/28102, WO 94/28103, WO 95/00626, WO 95/14759 and WO 95/17498. The hydrophilically substituted acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Conventional bleach activators such as these are present in the usual quantities, preferably in quantities of 0.1% by weight to 10% by weight and more preferably in quantities of 0.5% by weight to 7% by weight, based on the detergent as a whole.

In addition to instead of the conventional bleach activators mentioned above, the sulfonimines known from European patents EP 0 446 982 and EP 0 453 003 and/or bleach-boosting transition metal salts or transition metal complexes may be present as so-called bleach catalysts. Suitable transition metal compounds include in particular the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 or in European patent applications EP 0 458 397, EP 0 458 398, EP 0 549 271, EP 0 549 272, EP 0 544 490 and EP 0 544 519. Combinations of bleach activators and transition metal bleach catalysts are known, for example, from German patent application DE 196 13 103 and International patent application WO 95/27775. Bleach-boosting transition metal salts and/or complexes, more particularly containing the central atoms Mn, Fe, Co, Cu, Mo, V, Ti and/or Ru, are used in typical quantities, preferably in quantities of up to 1% by weight, more preferably in quantities of 0.0025% by weight to 0.5% by weight and most preferably in quantities of 0.01% by weight to 0.1% by weight, based on the detergent as a whole. Particularly preferred bleach catalyst complexes include cobalt-, iron-, copper- and ruthenium-ammine complexes, for example $[Co(NH_3)_5Cl]Cl_2$ and/or $[Co(NH_3)_5NO_2]Cl_2$.

The machine dishwashing detergents according to the invention preferably contain the usual alkali carriers, for example alkali metal silicates, alkali metal carbonates and/or alkali metal hydrogen carbonates. The alkali carriers normally used include carbonates, hydrogen carbonates and alkali metal silicates with a molar $SiO_2$:$M_2O$ ratio (M=alkali metal atom) of 1:1 to 2.5:1. Alkali metal silicates may be present in quantities of up to 40% by weight, based on the detergent as a whole. However, the highly alkaline metasilicates are preferably not used at all as alkali carriers. The alkali carrier system preferably used in the detergents according to the invention is a mixture of carbonate and hydrogen carbonate, preferably sodium carbonate and hydrogen carbonate, which is present in a quantity of up to 50% by weight and preferably in quantity of 5% by weight to 40% by weight. The ratio of carbonate used to hydrogen carbonate used varies according to the pH value ultimately required.

In another embodiment, the detergents according to the invention contain 20% by weight to 60% by weight of water-soluble organic builder, more especially alkali metal citrate, 3% by weight to 20% by weight of alkali metal carbonate and 5% by weight to 40% by weight of alkali metal disilicate.

Anionic, nonionic and/or amphoteric surfactants, more especially low-foaming nonionic surfactants, may also be added to the detergents according to the invention to improve the removal of fatty-containing soils, as wetting agents and optionally as granulation aids in the production of the detergents. They may be added in quantities of up to 20% by weight, preferably in quantities of up to 10% by weight and more preferably in quantities of 0.5% by weight to 5% by weight. Extremely low-foaming compounds are normally used, especially in machine dishwashing detergents. Such compounds are preferably $C_{12-18}$ alkyl polyethylene glycol polypropylene glycol ethers containing up to 8 moles of ethylene oxide units and up to 8 moles of propylene oxide units in the molecule. However, other known low-foaming nonionic surfactants may also be used, including for example $C_{12-18}$ alkyl polyethylene glycol polybutylene glycol ethers containing up to 8 moles of ethylene oxide units and up to 8 moles of butylene oxide units in the molecule, end-capped alkyl polyalkylene glycol mixed ethers and the foaming, but ecologically attractive $C_{8-14}$ alkyl polyglucosides with a degree of polymerization of about 1 to 4 (for example APG® 225 and APG® 600 of Henkel KGaA) and/or $C_{12-14}$ alkyl polyethylene glycols containing 3 to 8 ethylene oxide units in the molecule. Surfactants from the glucamide family, for example alkyl-N-methyl glucamides in which the alkyl moiety preferably emanates from a $C_{6-14}$ fatty alcohol, are also suitable. The described surfactants may also be advantageously used in the form of mixtures, for example in the form of a mixture of alkyl polyglycoside with fatty alcohol ethoxylates or a mixture of glucamide with alkyl polyglycosides.

If desired, the dishwashing detergents according to the invention may contain silver corrosion inhibitors. Preferred silver corrosion inhibitors are organic sulfides, such as cystine and cysteine, dihydric or trihydric phenols, optionally alkyl-, aminoalkyl- or aryl-substituted triazoles, such as benzotriazole, isocyanuric acid, manganese, cobalt, titanium, zirconium, hafnium, vanadium or cerium salts and/or complexes in which the metals mentioned have the oxidation number II, III, IV, V or VI, depending on the metal. The content of silver corrosion inhibitors in the detergents according to the invention is preferably in the range from 0.01% by weight to 1.5% by weight and more preferably in the range from 0.1% by weight to 0.5% by weight. Thus, the manganese(III) or manganese(IV) complexes known from International patent application WO 94/19445, the cysteine disclosed as a silver protector in the International patent application WO 94/07981, the cystine described in German patent application DE 195 18 693 as having a silver-corrosion-inhibiting effect either on its own or, in particular, in combination with isocyanuric acid and/or the titanium, zirconium, hafnium, vanadium, cobalt or cerium salts and/or complexes described in German patent applications DE 43 25 922 or DE 43 15 397, in which the metals have the oxidation number II, III, IV, V or VI, and the manganese(II) salts or complexes mentioned in those patent applications may be used in the detergents according to the invention to prevent the corrosion of silver.

The detergents according to the invention may additionally contain enzymes, such as proteases, amylases, pullulanases, cutinases and lipases, for example proteases, such as BLAP®, Optimase®, Opticlean®, Maxacal®, Maxapem®, Esperase®, Savinase®, Purafect® OxP and/or Durazym®, amylases, such as Termamyl®, Amylase-LT®, Maxamyl®, Duramyl® and/or Purafect® OxAm, lipases, such as Lipolase®, Lipomax®, Lumafast® and/or Lipozym®. The enzymes optionally used may be adsorbed onto supports and/or encapsulated in shell-forming substances to protect them against premature inactivation, as described for example in International patent applications WO 92/11347 or WO 94/23005. They are present in the detergents according to the invention in quantities of preferably up to 2% by weight and more preferably in quantities of 0.1% by weight to 1.5% by weight, enzymes stabilized against oxidative degradation, as known for example from International patent applications WO 94/02597, WO 94/02618, WO 94/18314, WO 94/23053 or WO 95/07350, being particularly preferred.

If the detergents foam too vigorously in use, preferably up to 6% by weight and more preferably about 0.5% by weight to 4% by weight of a foam-suppressing compound, preferably from the group of silicone oils, mixtures of silicone oil and hydrophobicized silica, paraffins, paraffin/alcohol combinations, hydrophobicized silica, bis-fatty acid amides and other known commercially available defoamers, may be added to them. Other optional ingredients in the detergents according to the invention are, for example, perfume oils.

Organic solvents suitable for use in the detergents according to the invention, particularly where they are present in liquid or paste-like form, include alcohols containing 1 to 4 carbon atoms, more especially methanol, ethanol, isopropanol and tert.butanol, diols containing 2 to 4 carbon atoms, more especially ethylene glycol and propylene glycol, and mixtures thereof and the ethers derivable from the classes of compounds mentioned. Water-miscible solvents such as these are present in the detergents according to the invention in quantities of preferably not more than 20% by weight and more preferably in quantities of 1% by weight to 15% by weight.

In order to establish a desired pH value which is not automatically established by the mixture of the other components, the detergents according to the invention may contain system-compatible and environmentally compatible acids, more particularly citric acid, acetic acid, tartaric acid, malic acid, lactic acid, glycolic acid, succinic acid, glutaric acid and/or adipic acid and also mineral acids, more especially sulfuric acid, or alkali metal hydrogen sulfates or bases, more especially ammonium or alkali metal hydroxides. pH regulators such as these may be present in the detergents according to the invention in quantities of preferably not more than 10% by weight and, more preferably, in quantities of 0.5% by weight to 6% by weight.

The production of the solid detergents according to the invention does not involve any difficulties and may be carried out in known manner, for example by spray drying or granulation, the peroxygen compound and the bleach catalyst being separately added, optionally at a later stage.

Detergents according to the invention in the form of aqueous solutions or solutions containing other typical solvents are produced with particular advantage simply by mixing the ingredients which may be introduced into an automatic mixer either as such or in the form of a solution.

The detergents according to the invention are preferably present as powder-form, granular or tablet-form preparations which are produced in known manner, for example by mixing, granulation, roll compacting and/or by spray drying of the heat-sensitive components and addition of the more sensitive components, including in particular enzymes, bleaching agents and the bleach activator.

Tablet-form detergents according to the invention are preferably produced by mixing all the ingredients in a mixer and tabletting the resulting mixture in conventional tablet presses, for example eccentric presses or rotary presses, under pressures of $200 \cdot 10^5$ Pa to $1500 \cdot 10^5$. Fracture-resistant tablets which still dissolve sufficiently quickly under in-use conditions with flexural strengths of normally above 150 N are readily obtained in this way. A tablet produced in this way preferably weighs from 15 g to 40 g and, more particularly, from 20 g to 30 g for a diameter of 35 mm to 40 mm.

The production of detergents according to the invention in the form of dust-free, storable free-flowing powders and/or granules with bulk densities of 800 to 1,000 g/l may be carried out by mixing the builder components with at least part of the liquid components in a first process step in which the bulk density of this premix is increased and then combining the other ingredients of the detergent, including the bleaching catalyst, with the premix thus obtained, if desired after drying.

Dishwashing detergents according to the invention may be used both in domestic dishwashing machines and in institutional dishwashing machines. They are added either by hand or by means of suitable dispensers. The in-use concentrations in the wash liquor are generally about 1 to 8 g/l and preferably from 2 to 5 g/l.

A machine dishwashing program is generally augmented and terminated by a few intermediate rinses with clear water after the main wash cycle and a final rinse with a conventional rinse aid. Using the dishwashing detergent according to the invention, completely clean and hygienically satisfactory dishes are obtained after drying.

EXAMPLES

A machine dishwashing detergent (V1) containing 45 parts by weight of sodium citrate, 5 parts by weight of sodium carbonate, 30 parts by weight of sodium hydrogen carbonate, 1 part by weight of protease granules and 1 part by weight of amylase granules, 2 parts by weight of nonionic surfactant and 10 parts by weight of sodium perborate monohydrate and detergents according to the invention (M1 to M5), which had the same composition as V1, but also contained the additions shown in Table 1 (parts by weight), the acetonitrile derivative being separately added as an aqueous solution at the beginning of the main wash cycle, were tested as follows:

To produce standardized tea coatings, teacups were immersed 25 times in a tea solution heated to 70° C. Thereafter, a little of the tea solution was poured into each teacup and the teacups were dried in a drying cabinet. Eight of the tea-coated cups were washed in a Miele® G 590 dishwashing machine (detergent dosage 20 g, water hardness ca. 17° dH, operating temperature 55° C.), after which removal of the tea coating was visually evaluated on a scale of 0 (=unchanged very thick coating) to 10 (=no coating). The scores shown in Table 2 for the detergents according to the invention are significantly better than the scores awarded to the comparison products V1 and V2 which contained the standard bleach activator TAED.

TABLE 1

Composition of machine dishwashing detergents

| Detergent | Addition |
|---|---|
| M1 | 3 Parts by weight of N-methyl morpholinium acetonitrile methosulfate |
| M2 | 3 Parts by weight of N-methyl morpholinium acetonitrile methosulfate and 0.03 part by weight of nitropentammine cobalt(III) chloride |
| M3 | 4 Parts by weight of N-methyl morpholinium acetonitrile methosulfate |
| M4 | 4 Parts by weight of N-methyl morpholinium acetonitrile methosulfate and 0.03 part by weight of nitropentammine cobalt(III) chloride |
| M5 | 6 Parts by weight of N-methyl morpholinium acetonitrile methosulfate |
| V2 | 4 Parts by weight of TAED |

TABLE 2

Scores for coating removal

| Detergent | Coating removal |
|---|---|
| M1 | 5 |
| M2 | 7 |
| M3 | 7 |
| M4 | 9 |
| M5 | 9 |
| V1 | 2 |
| V2 | 4 |

It can be seen that a significantly better bleaching effect can be obtained by the use according to the invention than by the conventional bleach activator TAED.

What is claimed is:

1. A method for washing dishes containing colored soil comprising:

(a) combining an oxidizing agent consisting of one or more compounds selected from the group consisting of organic peracids, hydrogen peroxide, perborate and percarbonate with a bleach-catalyzing transition metal complex or salt and an activator compound of the formula I:

$$R^1R^2R^3N^+CH_2CN\ X^- \quad (I)$$

wherein $R^1$, $R^2$ and $R^3$ independently of one another represent an alkyl, alkenyl or aryl group containing 1 to 18 carbons, atoms, X is an anion, and wherein $R^2$ and $R^3$ together with the quaternary N atom in formula I comprise a morpholinium ring, to form an aqueous dishwashing detergent; and (b) contacting a dish surface having colored soils with said dishwashing detergent.

2. The method of claim 1 wherein $R^1$ of formula I comprises an alkyl group containing 1 to 3 carbon atoms.

3. The method of claim 2 wherein $R^1$ of formula I comprises a methyl group.

4. The method of claim 1 wherein $X^-$ of formula I is selected from the group consisting of halides, nitrate, hydroxide, hexafluorophosphate, metho- and ethosulfate, chlorate, perchlorate and the anions of carboxylic acids.

5. The method of claim 1 wherein $X^-$ of formula I comprises methosulfate.

6. The method of claim 1 wherein the dishwashing detergent comprises 1 percent to 10 percent by weight of the activator compound of formula I.

7. The method of claim 6 wherein the dishwashing detergent comprises 3 percent to 6 percent by weight of the activator compound of formula I.

8. The method of claim 1 wherein the dishwashing detergent comprises:

(a) 15 percent to 70 percent by weight of a water-soluble builder compound;

(b) 5 percent to 25 percent by weight of a peroxygen compound;

(c) 3 percent to 6 percent by weight of the activator compound of formula I.

9. The method of claim 8 comprising:

(a) 20 percent to 60 percent by weight of a water-soluble builder compound;

(b) 8 percent to 17 percent by weight of a peroxygen compound;

(c) 3 percent to 6 percent by weight of the activator compound of formula I.

10. The method of claim 1 wherein the aqueous dishwashing detergent further comprises 0.5 percent to 7 percent by weight of a compound capable of forming peroxocarboxylic acid under perhydrolysis conditions.

11. The method of claim 1 wherein the aqueous dishwashing detergent comprises 0.0025 percent to 0.5 percent of bleach-catalyzing transition metal salts or complexes.

12. The method of claim 11 wherein the aqueous dishwashing detergent comprises cobalt-, iron-, copper-, or ruthenium-ammine complexes.

13. The method of claim 1 wherein the dishwashing detergent contacts the dish surfaces in a dishwashing machine.

14. The method of claim 1 wherein the dishwashing detergent contains from 0.00001 mole to 0.25 mole activator compound for each mole of peroxygen compound.

15. The method of claim 14 wherein the dishwashing detergent contains from 0.001 mole to 0.02 mole activator compound for each mole of peroxygen compound.

16. The method of claim 1 wherein contact between the dishwashing detergent and dish surface occurs at a temperature of 15° C. to 55° C.

* * * * *

UNITED STATES PATENT AND TRADEMARK OFFICE

CERTIFICATE OF CORRECTION

PATENT NO. : 6,225,274 B1
DATED : May 1, 2001
INVENTOR(S) : Nitsch et al.

It is certified that error appears in the above-identified patent and that said Letters Patent is hereby corrected as shown below:

Title page,
Item [73], Assignee, delete "Kommandigesellschaft", and insert therefor -- Kommanditgesellschaft --.

Column 10,
Line 33, delete "18 carbons, atoms", and insert therefor -- 18 carbon atoms --.

Signed and Sealed this

Eighth Day of July, 2003

JAMES E. ROGAN
*Director of the United States Patent and Trademark Office*